US006331047B1

(12) United States Patent
Muramatsu et al.

(10) Patent No.: US 6,331,047 B1
(45) Date of Patent: Dec. 18, 2001

(54) INK RECORDING HEAD AND INK INJECTING METHOD USING INK RECORDING HEAD

(75) Inventors: Hiroyuki Muramatsu; Seiji Kuwahara; Atsuya Akase; Kouji Kawaguchi; Tatsuru Sato, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/326,151

(22) Filed: Jun. 4, 1999

(30) Foreign Application Priority Data

Jun. 5, 1998 (JP) ..... 10-157715
Mar. 1, 1999 (JP) ..... 11-052826

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 20, 10, 5, 11; 399/271, 290, 292, 293, 294, 295

(56) References Cited

U.S. PATENT DOCUMENTS 4,700,204 10/1987 Nakayama .

FOREIGN PATENT DOCUMENTS 0778134 6/1997 (EP) .
0838335 4/1998 (EP) .
9184930 7/1997 (JP) .

*Primary Examiner*—Raquel Yvette Gordon
(74) *Attorney, Agent, or Firm*—Admas & Wilks

(57) ABSTRACT

By manipulating a relative potential relationship of potentials by voltages applied to selected electrodes, nonselected electrodes and an opposed electrode 20 among a plurality of record electrodes 13*a* through 13*z* installed at vicinities of an opening portion 11 of a head, ink is injected, printing of high resolution is made possible and by using a dispersing type ink and changing polarities of the voltages applied to the opposed electrode 20 and the record electrodes, density of injected ink is made variable.

38 Claims, 8 Drawing Sheets

INK RECORDING HEAD AND INK INJECTING METHOD USING INK RECORDING HEAD

BACKGROUND OF THE INVENTION

The present invention relates to an ink recording head, to a method of driving the ink recording head, and to an ink injecting method including the ink recording head to provide on record paper an output image capable of dealing with wide needs of from the printing industry where high-speed output of high quality image is requested to the printer industry based on office or personal request, and of the civil article industry requesting low-priced general output devices or the like using a variety of kinds and uses of record paper.

FIG. 10 shows an example of a method of driving an ink recording head used in a conventional electrostatic acceleration type ink jet recording system. FIG. 10 is a perspective view of an ink recording head. In FIG. 10, a plurality of record electrodes 13 are installed in the head, a voltage is applied to an opposed electrode whose illustration is omitted in FIG. 10 and ink is injected by applying high voltage only to a selected electrode such that a potential difference between the selected electrode and the opposed electrode is increased. The electrodes 13 are divided into a number of electrodes between an upper plate 12*a* and a lower plate 12*b* to form ink supply ports 11 at predetermined intervals and are arranged as spacers. When ink (not shown) is injected into the ink supply port 11, since the electrode 13 is wetted by the ink, the partitioned supply port 11 is concealed and the ink 2 forms continuous meniscus. Under such a continuous state, when high voltage pulses are applied while selectively scanning a plurality of the record electrodes 13, an ink drop is injected only from a vicinity of a position of the electrode applied with the pulse voltage. (Refer to JP-A-56-167465)

However, in the record head and the recording method in the conventional electrostatic acceleration type ink jet recording system, there have been the following problems.

(1) When intervals among the plurality of record electrodes installed in the head are set to be sufficiently smaller than a distance between the head and the opposed electrode in order to obtain a high resolution, in carrying out printing, since a constant voltage pulse is applied only to the record electrode for injecting the ink, a large potential difference is produced between the selected record electrode and the nonselected record electrode and its influence becomes more significant than in respect of the opposed electrode. Since the record electrode supplies electric charge to the ink and the adjacent record electrodes are electrically connected via the ink, voltage drop is caused between the adjacent electrodes, a potential difference necessary for injecting the ink is not produced and there is a case in which the ink is not injected or the selectivity of the position of injecting the ink is deteriorated.

(2) Density of the ink injected from the head is determined by properties of the ink and in order to express an intermediary tone by changing the density, there has been only such means as for injecting the ink to the same position by a plural number of times, or expressing the intermediary tone by a magnitude of an area, or preparing several kinds of inks.

SUMMARY OF THE INVENTION

According to the invention, voltages are applied to a plurality of record electrodes and an opposed electrode not only by controlling a potential relationship between a selected record electrode among a plurality of the electrodes and the opposed electrode by switching, but also by controlling a relative potential relationship among the opposed electrode, the selected record electrode and a nonselected record electrode by switching such that a voltage having a polarity reverse to that of the opposed electrode is applied to the nonselected record electrode among the plurality of record electrodes installed at vicinities of an opening portion of a head.

In this way, by applying the voltages not only by controlling the potential relationship between the selected electrode and the opposed electrode among the plurality of record electrodes but also by controlling the relative potential relationship between the opposed electrode and the selected electrode as well as between the selected electrode and the nonselected record electrode, the voltages can be applied to the ink in consideration of the influence the adjacent electrodes of the plurality of record electrodes and the resolution is improved. Thus the problem that the ink is not injected or the selectivity of the position of injecting the ink is deteriorated as a result of narrowing the intervals of the electrodes installed in the head is resolved.

Further, by using an ink mixed with substances having two polarities, for example, an ink of a dispersing type in which a colorant is dispersed in a dispersion medium (electrostatic ink for an electrostatic plotter, or the like) and by inversing polarities of a relative potential relationship between -an opposed electrode and a selected electrode or between the opposed electrode and a nonselected electrode by the above-described ink injecting means or the like, density of the injected ink is made variable, so that such a problem can be resolved that since the density of the ink injected from the head is determined by properties of the ink, there has been only such means as for injecting the ink at the same position by a plural number of times in order to express an intermediary tone by changing the density.

DETAILED DESCRIPTION OF THE PREFERRED EMBODIMENTS

According to an ink injecting method and an ink recording head of the invention, ink is injected by applying voltages to a plurality of record electrodes installed at vicinities of an opening portion such that a relative potential relationship among the respective electrodes is controlled. Further, a record picture is formed by continuously performing the above ink injection.

Further, by preparing a plurality of similar heads, injecting inks having different colors from respective heads, carrying out printing by overlapping dots having respective colors and forming a record picture, a color image is formed.

In respect of a positional relationship among an opposed electrode, an opening portion and record paper, record paper can be arranged between the opening portion and the opposed electrode or the opposed electrode can be arranged between the opening portion and the record paper so as not to depend on material or shape of the record paper.

Embodiment 1

An explanation will be given of Embodiment 1 of an ink injecting method according to the invention in reference to FIG. 1 through FIGS. 3A, 3B and 3C.

Figure 1:
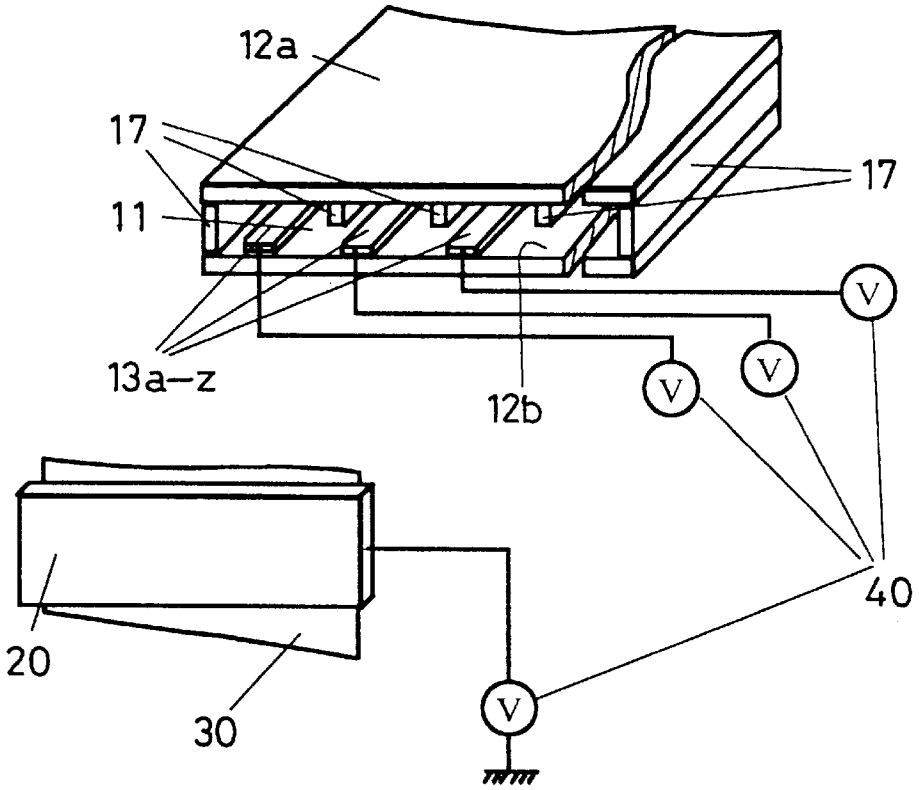
FIG. 1 is an explanatory view showing structures of a recording head, a record paper and an opposed electrode and a positional relationship among them according to first through sixth embodiments of the invention.
Figure 2:
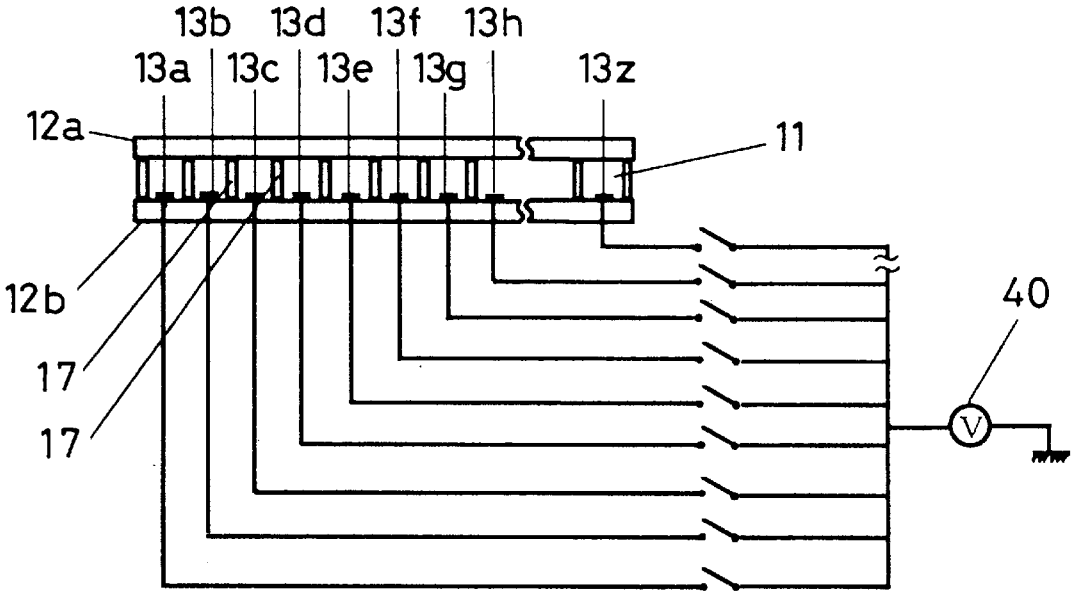
FIG. 2 is a plan view showing the structure of the recording head according to the embodiments of the invention.
Figure 3A:
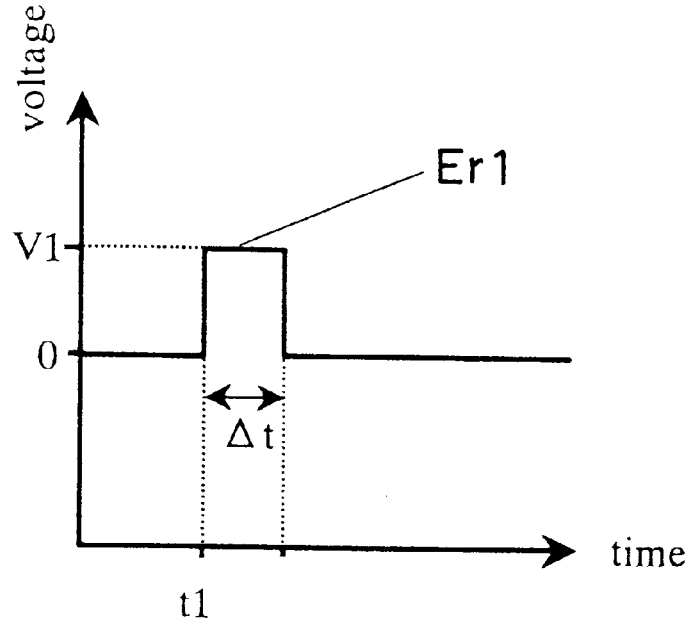
FIGS. 3A, 3B and 3C are explanatory views showing potentials of applied voltages according to the first, the second, a seventh and an eighth embodiments of the invention.
Figure 3B:
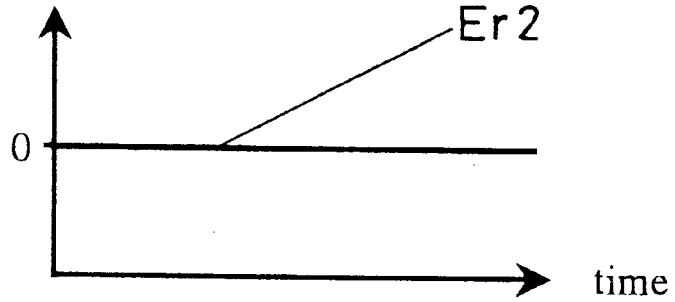
Figure 3C:
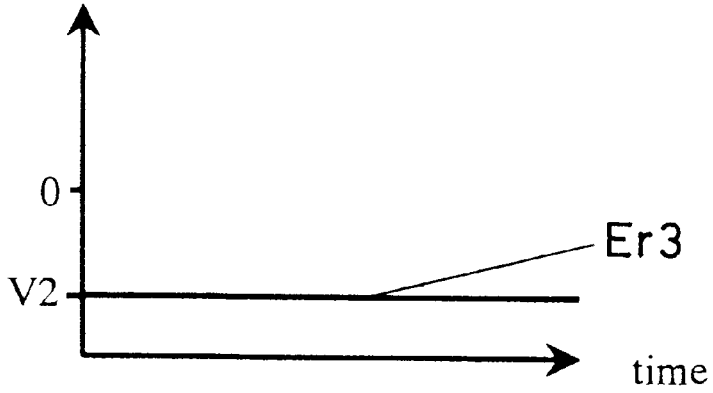

FIG. 1 is a perspective view of an ink recording head according to Embodiment 1 of the invention. FIG. 2 is a plan view when the ink recording head is seen from record a paper. FIG. 3A through FIG. 3C represent a potential relationship among voltages applied to respective electrodes.

First, an explanation will be given of constituent elements of the ink recording head according to the embodiment. A plurality of record electrodes 13*a* through 13*z* made of Al are arranged on a head lower plate 12*b* at constant intervals, a plurality of spacers 17 arranged at constant intervals are installed on the head lower plate 12*b*, an upper plate 12*a* is installed on the spacers 17 and an opening portion 11 is formed. The opening portion 11 communicates with an ink chamber (not shown). The record electrodes 13*a* through 13*z* are electrically bonded to a power supply 40 and each of the plurality of record electrodes 13*a* through 13*z* can be selectively applied with voltages. Incidentally, according to the embodiment, although 26 pieces of the record electrodes 13*a* through 13*z* are used, the record electrodes are not particularly restricted by this number of pieces and any number of pieces may be arranged on the head lower plate 12*b* so far as the number of pieces is 3 or more.

The opening portion 11 is formed by the upper plate 12*a*, the lower plate 12*b* and the spacers 17. The plurality of spacers 17 except ones forming side faces of the head exist on the side of the ink chamber of a front end of the head and the opening portion 11 is formed in a slit-like shape at the front end of the head.

Although it is pertinent that the thicknesses of the upper plate 12*a* and the lower plate 12*b* of the head are 30 through 200 $\mu$m, the size of the slit-like opening portion 11 is 30 through 300 $\mu$m in height and a width thereof is arbitrary, in this case, the thicknesses of the upper plate 12*a* and the lower plate 12*b* of the head are preferably set to 30 $\mu$m, the height of the slit-like opening portion 11 is set to 30 $\mu$m and the width thereof is preferably set to 10 mm.

Record paper 30 is arranged with a constant air gap being kept from the opening portion 11 and an opposed electrode 20 is installed on the rear face of the record paper 30. It is pertinent that the air gap between the opening portion 11 and the opposed electrode 20 is 0.1 mm to 1 mm and, in this case, it is preferably set to 0.5 mm. The opposed electrode 20 is connected to the power supply 40 and can be applied with a voltage at a potential different from that of the record electrodes 13*a* through 13*z*. The record paper may be normal plain paper, or non-paper material for OHP or the like can be used therefor.

Glass or Si or the like can be used for the head upper plate 12*a* and the head lower plate 12*b* and a patterning of the record electrodes 13*a* through 13*z* is fabricated by subjecting aluminum to vacuum deposition to apply it to a substrate and thereafter subjecting an aluminum thin film to chemical etching treatment. A number of pieces of the record electrodes is not particularly limited and is controlled by capacity of driver ICs for switching. Further, although it is pertinent that the record electrodes 13*a* through 13*z* are provided with a pitch of 50 through 150 $\mu$m, in this case they are fabricated by an electrode width of 70 $\mu$m and a pitch of 140 $\mu$m.

According to the embodiment, although the record electrodes 13*a* through 13*z* are formed by using aluminum as a material therefor, the material is not particularly limited thereto but a metal material such as copper, chromium, gold, nickel or the like may naturally be used.

Further, as long as a face of the opposed electrode 20 opposed to the opening portion 11 is in parallel therewith, other shape thereof is not particularly restricted. Although the opposed electrode 20 is made of stainless steel in this case, a metal material such as aluminum, copper or the like may be used.

Further, although in this case the spacer 17 is formed by forming an insulating film of a resist or the like on the head lower plate 12*b*, since it suffices if the upper plate 12*a* and the lower plate 12*b* are supported to provide a constant air gap, a film or the like whose thickness has already been known may be sandwiched between the upper plate 12*a* and the lower plate 12*b* and adhered to the respective plates.

In case of the invention, since it suffices if the record electrodes 13*a* through 13*z* for supplying electric charge to ink exist at the head portion, the head lower plate 12*b* per se may be formed by a metal material. However, since the record electrodes 13*a* through 13*z* are applied with high voltage, in this case it is preferable to coat surroundings thereof by an insulating member to avoid danger such as discharge, electric contact or the like with other member. Further, according to the embodiment, although the record electrodes 13*a* through 13*z* are formed by using aluminum as material therefor, the material is not particularly limited thereto but a metal material such as copper, chromium, gold, nickel or the like may be used. Further, positions of installing the record electrodes 13*a* through 13*z* are not limited to the head lower plate 12*b* but may be, for example, the upper plate 12*a* so far as the positions are in an arrangement capable of being brought into contact with ink and supplying electric charge thereto.

Next, hereunder a description will be given of conditions of ink used in the invention.

As factors significantly contributing to flying of ink as physical properties of ink, there are enumerated surface tension, viscosity and conductivity. As to a relationship between surface tension and a maximum interval of ink injected to the opposed electrode (hereinafter, referred to as maximum recording interval), when the conductivity and the viscosity are regarded to be constant, the maximum recording interval is increased with a decrease in the surface tension in a range of the surface tension of 20 through 50 dyne/cm. Hence, the smaller is the surface tension, the smaller becomes the resistance force in a procedure of injecting ink and ink can be injected even under a weak electric field, so that the maximum recording interval can be increased. Although generally the surface tension of water ink is high and is 72.8 dyne/cm (20° C.) in case of pure water, since the surface tension of an organic solvent falls in a range of 20 dyne/cm through 35 dyne/cm, as ink of the invention there can be used a dissolving type ink in which a colorant is dissolved in an organic solvent or a dispersing type ink in which a colorant is dispersed in an organic solvent. Further, the above maximum recording interval can also be increased by means of improving the surface tension by dissolving an anionic surfactant, a cationic surfactant, a nonionic surfactant or the like into the ink as a surfactant.

Although the viscosity of a solvent of the above ink can be selected in a wide range, since a solvent whose viscosity is low has high volatility, the preserving ability of the ink is poor and, in order to ensure the preserving ability, a solvent whose boiling point is in a range of 200° C. or higher is selected. As to a relationship between the viscosity and the maximum recording interval, when the surface tension and the conductivity are regarded to be constant, the maximum recording interval is increased with a decrease in the viscosity. Accordingly, similarly to the case of the surface tension, when the viscosity is low, the resistance force in the procedure of injecting ink becomes small and the maximum recording interval can be increased.

In order to inject above ink, although it is preferable that the conductivity is low because electric charge needs to be charged from the record electrodes 13*a* through 13*z* of the head portion to the ink, when the conductivity is excessively low, the electric charge is diffused inside the ink before the electric charge charged to the ink reaches a front end of a meniscus of the ink, so that the ink is not injected. Further, also when the conductivity is high, a discharge phenomenon is liable to occur between a selected electrode and a non-selected electrode or between the opposed electrode and the plurality of record electrodes, so that the ink is not injected stably. Therefore, as a pertinent range of the conductivity of the ink according to the invention, $1.0\times10^{-6}$ through $1.0\times10^{-10}$ (1/Ω/cm) is preferable. Further, also in a dispersing type ink in which a colorant is dispersed in a dispersion medium, for the similar reason it is preferable to use an ink having the conductivity of the dispersion medium in the above-described range.

Incidentally, with regard to the above set values of properties of ink, capability or incapability of flying ink is dependent upon values of voltages supplied between the above-described common electrode and the record electrodes on the opposed electrode, a distance to the above-described opposed electrode, an undermentioned slit width of an injection port, and the like, so that it is needless to say that optimum ranges of the properties such as the surface tension, the viscosity and so on are not necessarily limited to the above-described values.

Further, at the opening portion 11, the ink is supplied via an ink chamber while undergoing its own weight and substantially constant pressure by the atmospheric pressure by ink supply means (not shown). Static pressure applied to the ink is balanced with the surface tension of the ink at the opening portion 11, and forms a convex surface in a shape of half moon, that is, meniscus and holds this state.

The ink is injected to the record paper 30 from vicinities of arbitrary electrodes among the record electrodes 13*a* through 13*z* by means of controlling the voltages applied to the record electrodes 13*a* through 13*z* and the opposed electrode 20 by a switching circuit (not shown).

Thereby, dot-like recording is carried out and further a record picture is formed by continuously repeating the operation. Further, a color picture image can be depicted on the record paper 30 by means of preparing a plurality of ink recording heads as shown in FIGS. 1 and 2, causing the respective heads to inject inks having different colors and carrying out printing by overlapping a plurality of dots respectively having different colors.

An explanation will be given of a method of applying the voltages in the ink injecting method according to the invention in reference to FIG. 2 and FIG. 3A through FIG. 3C. FIG. 2 is a plan view when the head of FIG. 1 is seen from a direction of the opening portion 11. The plurality of record electrodes 13*a* through 13*z* are connected to the power supply 40 via a switching circuit (not shown) and arbitrary electrodes can be applied with the voltages.

FIG. 3A through FIG. 3C represent a potential relationship of the voltages applied on the respective electrodes. In FIG. 3A through FIG. 3C, Er1 is a voltage applied to electrodes at other than a position intended to inject ink among the plurality of record electrodes and Er2 is a voltage applied to an electrode at the position intended to inject ink. Further, Er3 is a voltage applied to the opposed electrode.

According to the embodiment, as shown in FIG. 3A, Er1 is a positive pulse voltage and a pulse width Δt thereof is about 0.1 ms through 50 ms. Further, as designated by Er2 in FIG. 3B, no voltage is applied thereto, but o volt is set to an electrode at the position intended to inject ink. An applied voltage V1 is about 500 V and V2 is about −500 through −2.0 kV and these are set in accordance with a desired print dot size and a set distance between the opposed electrode and the record electrode.

In FIG. 2, when ink at a position in a vicinity of the record electrode 13*c* is intended to inject, the voltage Er1 in FIG. 3A is applied to the electrodes of 13*a*, 13*b*, 13*d* through 13*z* other than the electrode 13*c* and the voltage Er3 is applied to the opposed electrode 20.

When the voltages are applied in this way, during a time period until a time period Δt has elapsed from time t1 in FIG. 3A through FIG. 3C, the ink at vicinities of electrodes other than the record electrode 13*c* is charged positively by the voltage Er1. The potential of the record electrode 13*c* becomes lower than those of the record electrodes other than the record electrode 13*c*. Further, since distances among the record electrodes are sufficiently narrower than distances between the opposed electrode and the record electrodes, ink at vicinities of electrodes other than the record electrode 13*c* charged positively is attracted to the record electrode 13*c*. Therefore, as a result, the liquid face of the ink is swollen in the vicinity of the record electrode 13*c* and, when it is swollen to a certain height the ink which has approached to the opposed electrode is attracted to the opposed electrode and, as a result, the ink is injected from the vicinity of the record electrode 13*c* toward the opposed electrode.

By controlling the pulse width Δt, the print dot diameter can be controlled and, for example, when Δt is 2 ms, the print dot diameter is about 100 μm and when Δt is 10 ms, it is about 400 μm.

Further, by selecting a plurality of pieces of electrodes corresponding to the above-described electrode 13*c* among the record electrodes 13*a* through 13*z*, the ink can be injected simultaneously from arbitrarily plural positions.

When the above-described dispersing type ink was used as ink, the pitch of the plurality of record electrodes was 70

μm, the interval between the opposed electrode and the opening portion was 500 μm, V1 was 500 V, V2 was −1.5 kV, the thicknesses of the upper plate 12*a* and the lower plate 12*b* of the head were 30 μm and the interval between the upper plate and the lower plate was 100 μm, the ink could be injected from arbitrarily two electrode positions with an interval of 420 μm therebetween and a minimum drive pulse width Δt was 0.5 ms.

Like this embodiment, when an ink constituted by two elements having different polarities, for example, an ink in which a colorant such as toner or the like is dispersed in a solvent, in the ink at a position of a record electrode other than the record electrode 13*c*, a repulsive force is exerted to one which is charged positively among the colorant such as toner or the like and the solvent at the position other than the record electrode 13*c*.

Although a negative voltage designated by Er3 in FIG. 3C is applied to the opposed electrode 20 and ink at positions of the record electrodes other than the record electrode 13*c* is attracted to the opposed electrode, since the potential of the record electrode 13*c* is relatively lower than the potential of the other record electrodes, when the distance between the record electrodes is small, the influence becomes more significant than that in respect of the opposed electrode, so that when a dispersing type ink is used, in the ink at positions of record electrodes other than the record electrode 13*c*, one charged positively among the colorant such as toner or the like and the solvent is moved toward the record electrode 13*c*.

In case of the conventional voltage applying method, for example, when ink in which a colorant such as toner or the like is dispersed in a petroleum-based solvent species is used and, with regard to the structure of the head, an interval between adjacent electrodes is 70 μm and a distance between an opposed electrode and a plurality of record electrodes is 500 μm, even if a applied potential between the opposed electrode and the plurality of record electrodes is increased to about 3.0 kV that is a potential causing a discharge phenomenon, ink is not injected from a desired ink injecting position by the voltage applying method for applying the voltages only to an electrode at a position corresponding to a desired ink injecting position among the plurality of record electrodes such that the potential difference becomes larger relative to the potential of the opposed electrode.

When the voltage applying method according to the embodiment is used, since the colorant such as toner or the like is liable to be charged positively, the colorant such as toner or the like is attracted at a vicinity of the record electrode 13*c*, so that the density of the colorant such as toner or the like of the ink at that vicinity is increased. Therefore, according to this method of applying the voltage, since the colorant such as toner or the like becomes liable to be injected, the density of ink adhered to record paper becomes dark. On this occasion, when the ink in which the colorant such as toner or the like is dispersed in a petroleum-based solvent is used and printing of dots having the same size was carried out on the same record paper, in contrast to the case in which polarities are reversed in the above-described voltage applying method, it was confirmed that the average reflectance of the print dot was increased and the density of the print dot was increased.

Embodiment 2

An explanation will be given of Embodiment 2 of an ink injecting method according to the invention in reference to FIG. 1 through FIGS. 3A, 3B and 3C.

FIG. 1 is a perspective view of the ink recording head according to Embodiments 1 through 6 of the invention. FIG. 2 is a plan view when the ink recording head is seen from record paper. FIG. 3A through FIG. 3C represent the potential relationship among the voltages applied to the respective electrodes. The kind of ink used differs from that in Embodiment 1, and in this embodiment a dissolving type ink in which a colorant is dissolved in a solvent is used. It is an ink having the above-described conductivity and a black ink having the conductivity of $5.0\times10^{-10}$ (1/Ω/cm), the surface tension of 24.4 (dyne/cm) and the viscosity of 4.2 (cps) is used. In FIG. 2, when ink at a position in a vicinity of the record electrode 13*c* is intended to inject, the voltage Er1 in FIG. 3A is applied to the electrodes 13*a*, 13*b*, 13*d* through 13*z* other than the electrode 13*c* and the voltage Er3 is applied to the opposed electrode 20 and 0 volt is set on the electrode 13*c*.

When the voltages are applied in this way, during a time period until a time period Δt has elapsed from time t1 in FIG. 3A through FIG. 3C, ink at vicinities of electrodes other than the record electrode 13*c* is charged positively by the voltage Er1. The potential of the record electrode 13*c* is lower than those of the record electrodes other than the record electrode 13*c*. Further, since a distance between the record electrodes is sufficiently narrower than the distance between the opposed electrode and the record electrodes, ink at vicinities of electrodes other than the record electrode 13*c* is attracted to the record electrode 13*c*. Accordingly, as a result, the ink liquid face is swollen at the vicinity of the record electrode 13*c* and when it is swollen to a certain height, the ink which has approached to the opposed electrode is attracted to the opposed electrode and, as a result, the ink is injected from the vicinity of the record electrode 13*c* toward the opposed electrode.

Since a diameter of a colorant of the dissolving type ink is smaller than that of the dispersing type ink, nonuniformity of color can be restrained and the print dot size can be reduced.

Embodiment 3

An explanation will be given of Embodiment 3 of an ink injecting method according to the invention in reference to FIG. 2 and FIG. 4A through FIG. 4C.

Figure 4A:
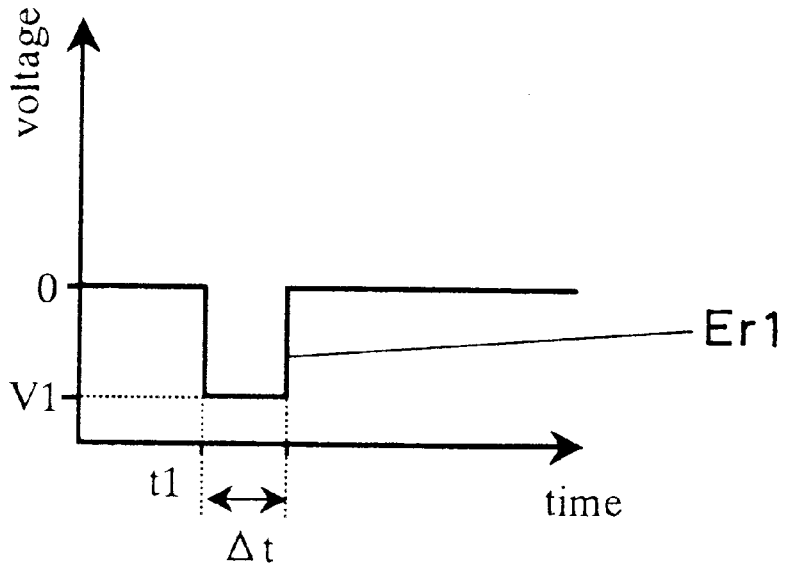
FIGS. 4A, 4B and 4C are explanatory views showing potentials of applied voltages according to the third, the seventh and the eighth embodiments of the invention.
Figure 4B:
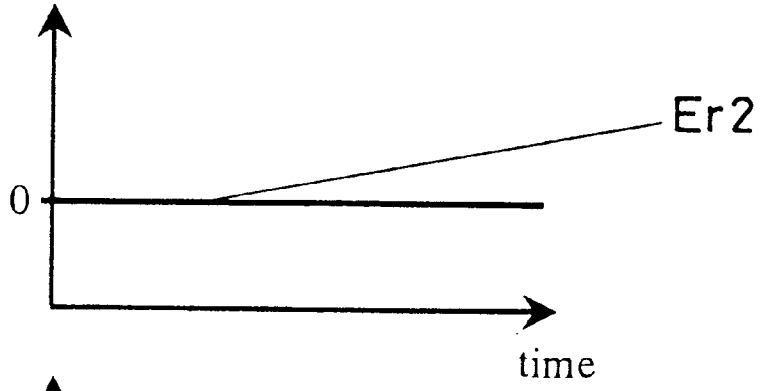
Figure 4C:
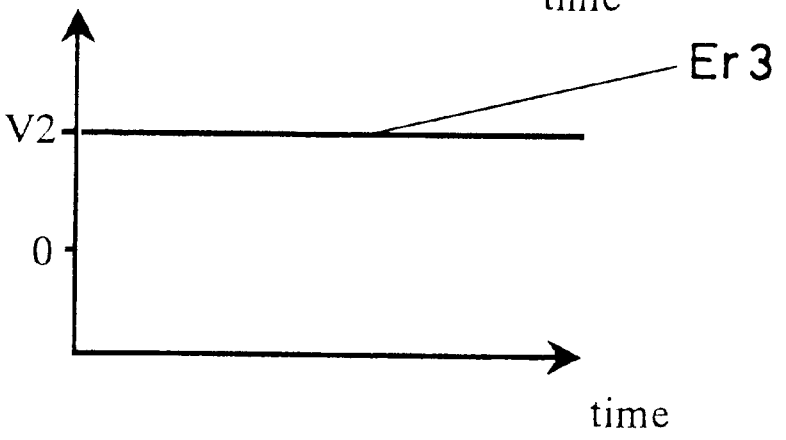

FIG. 4A through FIG. 4C show a relationship between potentials applied to the head and the opposed electrode, and polarities of voltages applied to the head and the opposed electrode are reversed from those of Embodiment 1. Incidentally, similarly to Embodiment 1, also in this embodiment, although 26 pieces of the record electrodes 13*a* through 13*z* are used as the plurality of record electrodes, the number is not particularly restricted to this number of pieces and any number of the plurality of electrodes may be arranged on the head lower plate 12*b* so far as the number is 3 or more.

In FIG. 2, when ink at the position of the record electrode 13*c* is intended to inject, voltage Er1 in FIG. 4A is applied to the electrodes 13*a*, 13*b* and 13*d* through 13*z* other than the electrode 13*c* and the record electrode 13*c* is applied with voltage Er2 shown in FIG. 4B wherein 0 volt is set. The opposed electrode is applied with voltage Er3 shown in FIG. 4C.

As described in Embodiment 2, when a normal dye-based ink is used, the ink liquid face at an arbitrary desired position is swollen by principle similar to that of Embodiment 1 and the ink is injected from the opening portion toward the opposed electrode.

When a dispersing type ink as in Embodiment 1 is used, in the ink at positions of electrodes other than the record electrode 13*c*, one which is charged negatively among the colorant such as toner or the like and the solvent is moved toward the record electrode 13*c*.

For example, in this case, since the colorant such as toner or the like is liable to be charged negatively, according to the voltage applying method of this embodiment, the solvent is liable to be injected and density of the ink adhered to the record paper becomes thin. When the same head, the same record paper and the same ink were used and voltages having different polarities and equal absolute values were applied, it was confirmed that the average reflectance of the print dot became smaller than that in Embodiment 1 and the density of the printed dot became thin.

Embodiment 4

Figure 5A:
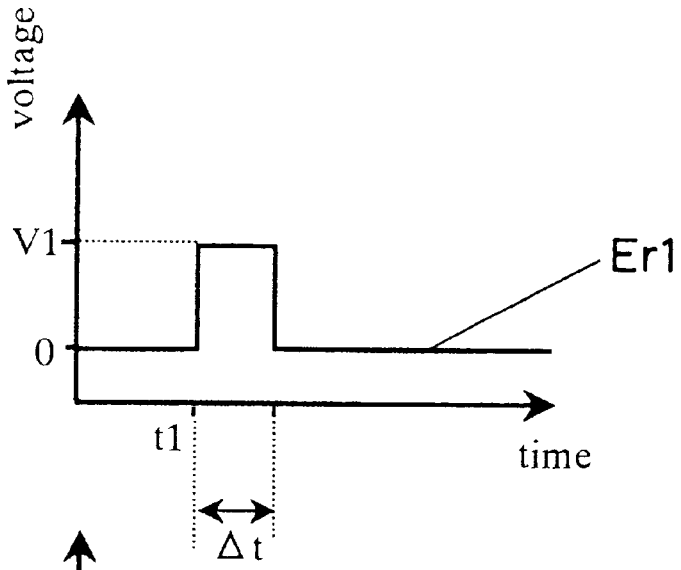
FIGS. 5A, 5B and 5C are explanatory views showing potentials of applied voltages according to the fourth, the seventh and the eighth embodiments of the invention.
Figure 5B:
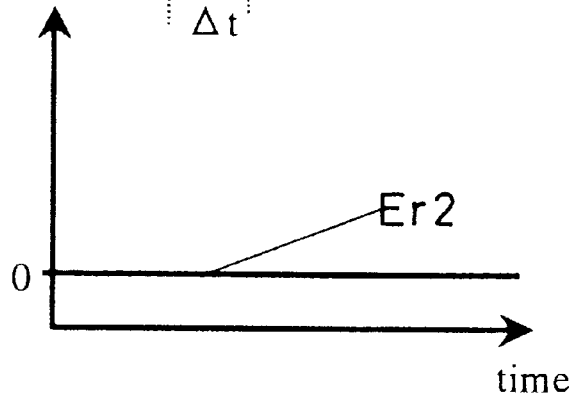
Figure 5C:
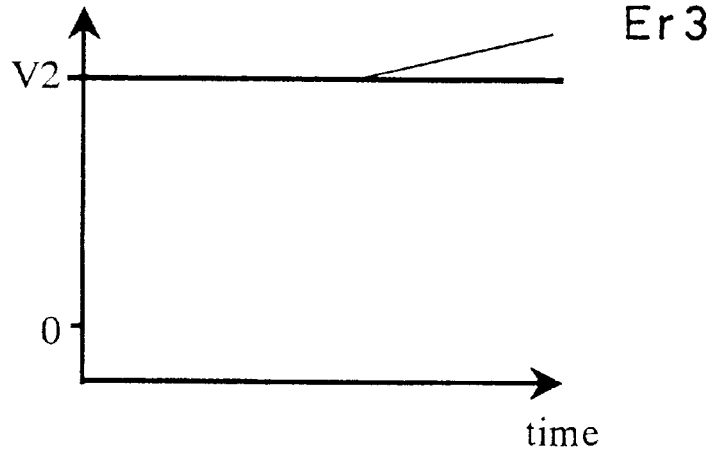

An explanation will be given of Embodiment 4 of an ink injecting method according to the invention in reference to FIG. 2 and FIG. 5A through FIG. 5C. FIG. 5A through FIG. 5C show a relationship between potentials applied to the head and the opposed electrode. Incidentally, similarly to Embodiment 1, also in this embodiment, although 26 pieces of the record electrodes 13*a* through 13*z* are used as the plurality of record electrodes, the number is not particularly restricted to this number of pieces and any number of pieces of the record electrodes may be arranged on the head lower plate 12*b* so far as the number is 3 or more.

In FIG. 2, when ink at the position of the record electrode 13*c* is intended to inject, voltage Er1 in FIG. 5A is applied to the record electrode 13*c* and voltage Er2shown in FIG. 5B is applied to the electrodes 13*a*, 13*b* through 13*z* other than the electrode 13*c* wherein 0 volt is set. The opposed electrode is applied with voltage Er3 shown in FIG. 5C.

When the voltage Er1 in FIG. 5A is applied to the record electrode 13*c*, during a time period until a time period Δt has elapsed from time t1 in FIG. 5A, a potential difference is caused between the record electrode 13*c* and the record electrodes other than the record electrode 13*c*, the ink liquid face at the vicinity of the record electrode 13*c* is charged positively and the potential of ink at the vicinities of electrodes other than the record electrode 13*c* becomes lower than that of the ink liquid face at the vicinity of the electrode 13*c*. Therefore, ink at vicinities of the electrodes other than the record electrode 13*c* is attracted to the vicinity of the record electrode 13*c* and, as a result, the liquid face at the vicinity of the record electrode 13*c* is swollen. Since the opposed electrode is applied with the positive voltage, ink which is swollen at the vicinity of the record electrode 13*c* and which is in a state of low potential is attracted to the opposed electrode at positive potential and, as a result, the ink is injected toward the opposed electrode.

When a dispersing type ink is used, in the ink at positions of electrodes other than the record electrode 13*c*, one which is charged negatively among the colorant such as toner or the like and the solvent is moved toward the record electrode 13*c*.

Accordingly, the liquid face at the vicinity of the record electrode 13*c* is relatively swollen and attracted to the side of the opposed electrode, and the ink is injected.

For example, in this case, since the colorant such as toner or the like is liable to be charged negatively, according to this voltage applying method, the solvent is liable to be injected and the density of the injected ink becomes thin.

When the above-described dielectric ink was used as an ink, the pitch of the plurality of record electrodes was 70 μm, the interval between the opposed electrode and the opening portion was 500 μm, V1 was 500 V, V2 was −1.5 kV, thicknesses of the upper plate 12*a* and the lower plate 12*b* of the head were 30 μm and an interval between the upper plate and the lower plate was 100 μm, the ink could be injected from arbitrarily two electrode positions with an interval of 420 μm therebetween and a minimum drive pulse width Δt was 0.5 ms.

Embodiment 5

Figure 6A:
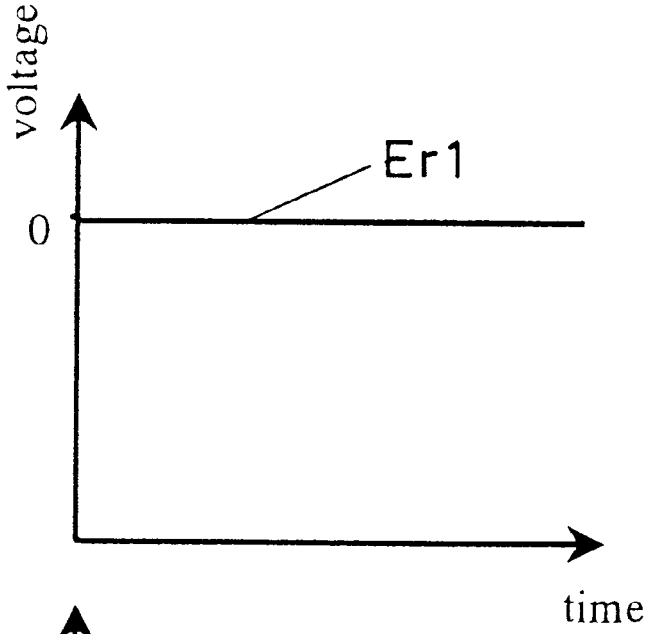
FIGS. 6A, 6B and 6C are explanatory views showing potentials of applied voltages according to the fifth, the seventh and the eighth embodiments of the invention.
Figure 6B:
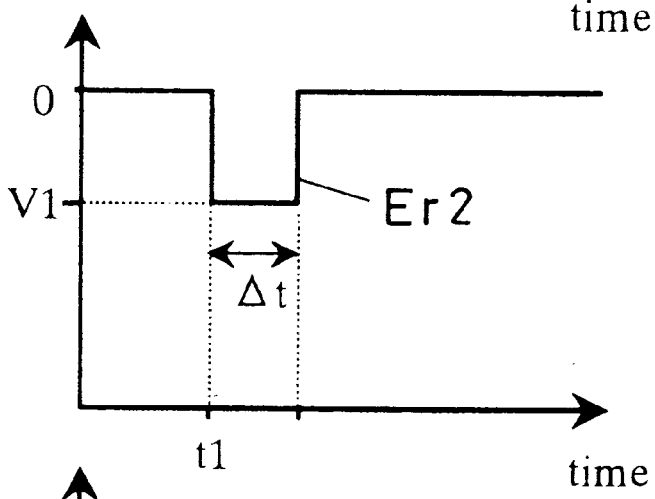
Figure 6C:
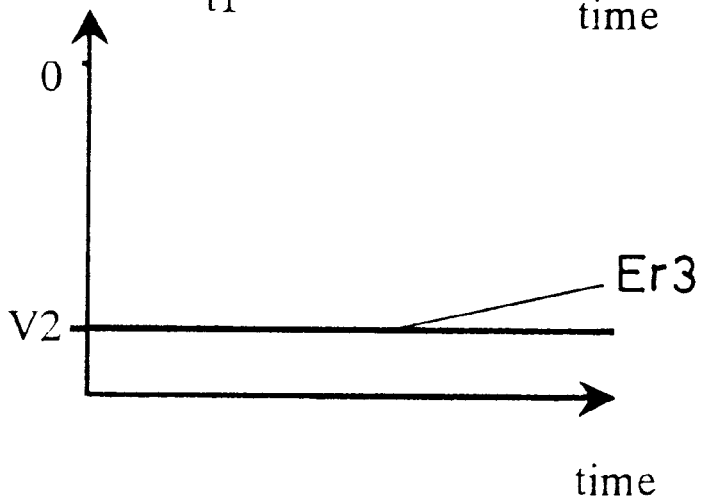

An explanation will be given of Embodiment 5 of an ink injecting method according to the invention in reference to FIG. 2 and FIG. 6A through FIG. 6C. FIG. 6A through FIG. 6C show a relationship between potentials applied to the head and the opposed electrode, and polarities of voltages applied to the head and the opposed electrode are reversed from those in Embodiment 3. Incidentally, similarly to Embodiment 1, also in this embodiment, although 26 pieces of the record electrodes 13*a* through 13*z* are used as the plurality of record electrodes, the number is not particularly restricted to this number of pieces and any number of the electrodes may be arranged on the lower plate 12*b* of the head so far as the number is 3 or more.

In FIG. 2, when ink at the position of the record electrode 13*c* is intended to inject, voltage Er1 in FIG. 6A is applied to the electrodes 13*a*, 13*b* and 13*d* through 13*z* other than the electrode 13*c* wherein 0 volt is set and the voltage Er2 shown in FIG. 6B is applied to the record electrode 13*c*.

Voltage Er3 shown in FIG. 6C is applied to the opposed electrode.

By theory similar to that of Embodiment 3, ink can be injected from a vicinity of an arbitrary electrode.

When the voltage Er2 is applied to the record electrode 13*c*, a potential difference is caused between the record electrode 13*c* and the record electrodes other than the record electrode 13*c*, the ink liquid face at the vicinity of the record electrode 13*c* is charged negatively, and the potential of ink at vicinities of record electrodes other than the record electrode 13*c* becomes higher than the potential at the vicinity of the record electrode 13*c*. Therefore, ink whose potential is increased at vicinities of the record electrodes other than the record electrode 13*c* is attracted to the vicinity of the record electrode 13*c* and, as a result, the liquid face at the vicinity of the record electrode 13*c* is swollen. Since the opposed electrode is applied with negative voltage, the liquid face is swollen at the vicinity of the record electrode 13*c* and ink whose potential of which is increased is attracted to the opposed electrode at the negative potential and, as a result, the ink is injected toward the opposed electrode.

When a dispersing type ink is used, in the ink at the positions of the electrodes other than the record electrode 13*c*, one which is charged negatively among the colorant such toner or the like and the solvent is moved toward the opposed electrode 13*c*.

Accordingly, the liquid face at the vicinity of the record electrode 13*c* is relatively swollen and attracted to the side of the opposed electrode, and the ink is injected.

For example, in this case, since the colorant such as toner or the like is liable to be charged negatively, according to this voltage applying method, the solvent is liable to be injected and the density of the ink adhered to record paper becomes thin.

Embodiment 6

Figure 7A:
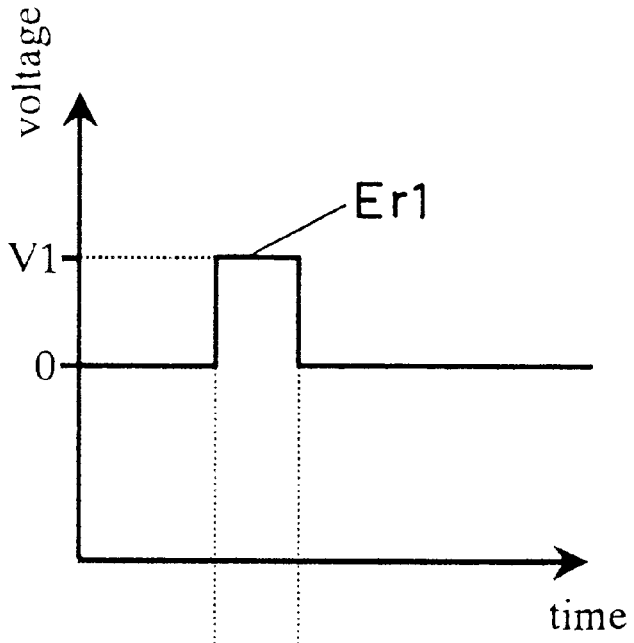
FIGS. 7A, 7B and 7C are explanatory views showing potentials of applied voltages according to the sixth, the seventh and the eighth embodiments of the invention.
Figure 7B:
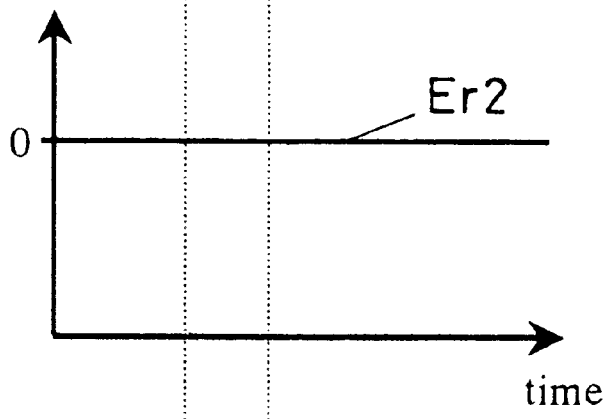
Figure 7C:
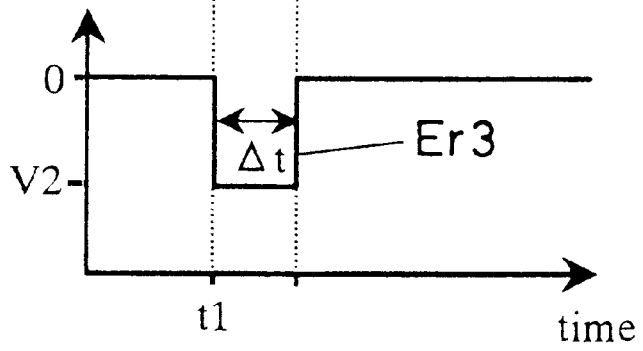

An explanation will be given of Embodiment 6 of an ink injecting method according to the invention in reference to FIG. 2 and FIG. 7A through FIG. 7C. FIG. 7A through FIG. 7C show a relationship between potentials applied to the head and the opposed electrode. In FIG. 7A through FIG. 7C, Er3 is voltage applied to the opposed electrode and voltages designated by Er1 and Er2 correspond to any of combinations described in Embodiments 1 through 4. Incidentally, similarly to Embodiment 1, also in this embodiment, although 26 pieces of the record electrodes 13*a* through 13*z* are used as the plurality of record electrodes, the number is not particularly restricted to this number of pieces and any number of electrodes may be arranged on the lower plate 12*b* of the head so far as the number is 3 or more.

By constituting also the voltage applied to the opposed electrode by a pulse voltage in this way, since it suffices if the voltage is applied only when ink is intended to inject, power conservation is made possible. Further, since it is prevented that ink is excessively charged, ink can be injected substantially stably from start to finish of printing.

It is not necessary that the pulse voltages Er1 and Er3 are synchronized with each other, and it suffices if when the pulse voltage of Er1 is ON the pulse voltage of Er3 at the side of the opposed electrode is also ON. When a dielectric ink was used as an ink, the pitch of the plurality of record electrodes was 70 $\mu$m, the interval between the opposed electrode and the opening portion was 500 $\mu$m, V1 was 500 V, V2 was −1.5 kV, the thicknesses of the upper plate 12*a* and the lower plate 12*b* of the head were 30 $\mu$m and the interval between the upper plate and the lower plate was 100 $\mu$m, ink could be injected from arbitrarily two electrode positions with an interval of 420 $\mu$m therebetween and a minimum drive pulse width $\Delta t$ was 0.5 ms.

Embodiment 7

Figure 8:
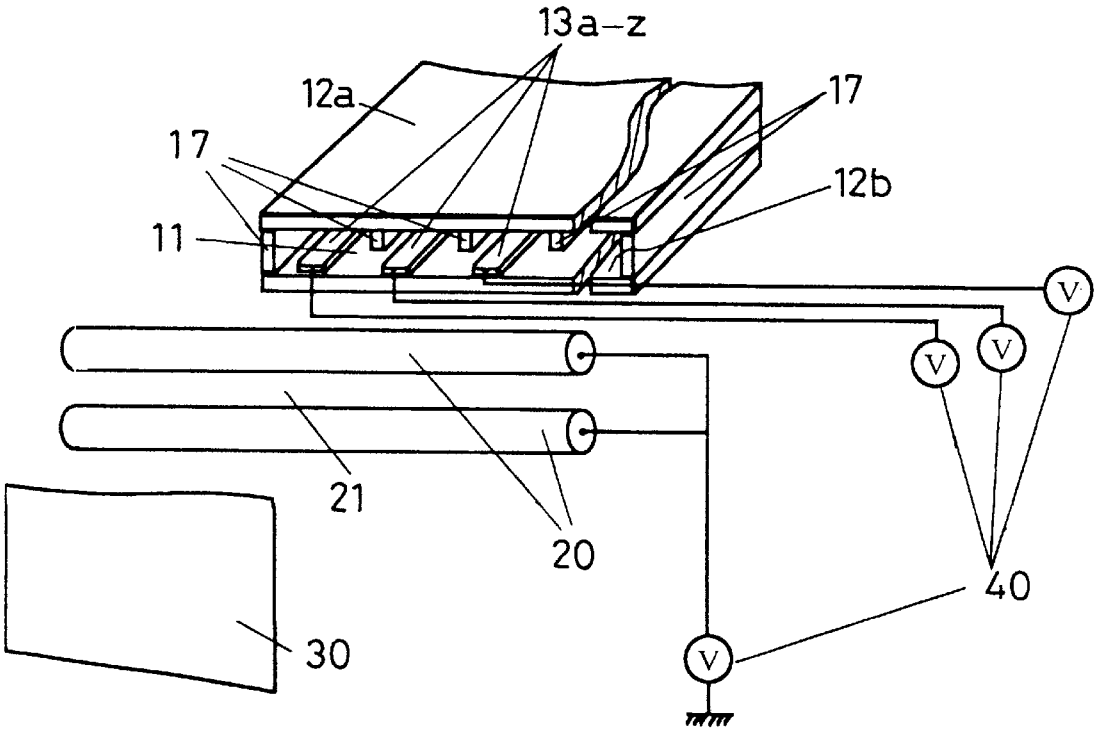
FIG. 8 is an explanatory view showing structures of the recording head, record paper and an opposed electrode and a positional relationship among them according to the seventh embodiment of the invention.

An explanation will be given of Embodiment 7 in which a positional relationship between an opposed electrode and an opening portion is changed in an ink injecting method according to the invention in reference to FIG. 8. FIG. 8 is a perspective view showing a positional relationship among the ink recording head, the opposed electrode, the ink record paper and the power supply 40.

In FIG. 8, the opening portion 11, the plurality of record electrodes 13*a* through 13*z*, the spacers 17, the upper plate 12*a* and the lower plate 12*b* are the same as those in Embodiment 1. Similarly to Embodiment 1, also in this embodiment, although 26 pieces of the record electrodes 13*a* through 13*z* are used as the plurality of record electrodes, the number is not particularly restricted to this number of pieces and any number of the electrodes may be arranged on the lower plate 12*b* of the head so far as the number is 3 or more.

The opposed electrode 20 is arranged between the opening portion 11 and the record paper 30 as shown in FIG. 8. As shown in FIG. 8, the opposed electrode 20 is constituted by two pieces of rod-like conductors which are connected to the power supply 40 and two of them becomes the same potential. The conductors are arranged such that a plane connecting the opening portion 11 and an ink recording portion on the record paper 30 exists between the two pieces of the opposed electrode.

The method of applying voltages to the respective electrodes is the same as means described in Embodiments 1 through 5. By arranging the opposed electrode 20 between the record paper 30 and the opening portion 11 in this way, ink can be injected without depending upon material and shape of the record paper 30.

Embodiment 8

Figure 9:
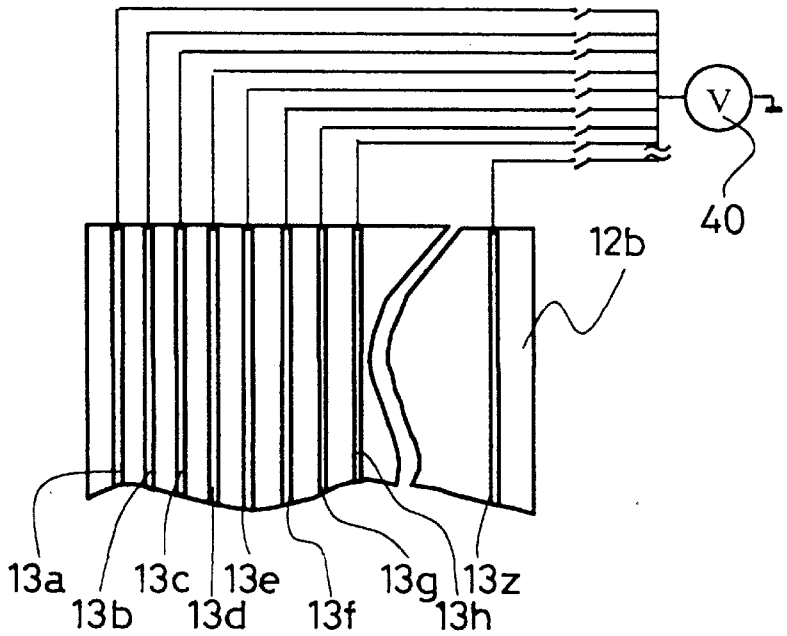
FIG. 9 is an explanatory view showing an arrangement of electrodes in a recording head according to the eighth embodiment of the invention.
Figure 10:
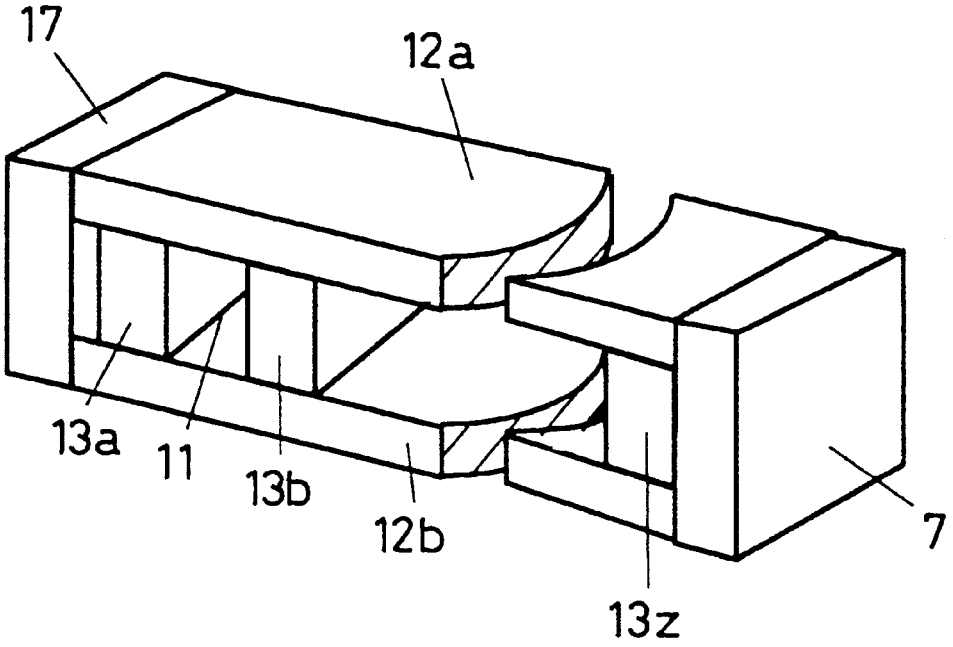
FIG. 10 PRIOR ART
FIG. 10 is an explanatory view showing a recording head of a conventional electrostatic acceleration type ink jet recording system.

An explanation will be given of Embodiment 8 in which ink is injected simultaneously from a plurality of portions in an ink injecting method according to the invention in reference to FIGS. 3A,3B and 3C through FIGS. 7A,7B and 7C and FIG. 9. FIG. 9 is a plan view when an arrangement of a plurality of record electrodes in the head is seen from above an upper plate of a head. In FIG. 9, the opposed electrode, the record paper, the spacers 17 and the upper plate 12*a* of the head are omitted.

Incidentally, similarly to Embodiment 1, also in this embodiment, although 26 pieces of the record electrodes 13*a* through 13*z* are used as the plurality of record electrodes, the number is not particularly restricted to this number of pieces and any number of the record electrodes may be arranged on the lower plate 12*b* of the head so far as the number is 3 or more. Similarly to Embodiment 1, the record electrodes 13*a* through 13*z* were fabricated with the electrode width being 70 $\mu$m and the pitch being 140 $\mu$m.

In case where ink is injected simultaneously from a plurality of arbitrarily selected portions, for example, in case where ink is injected from arbitrary two portions or the electrodes 13*c* and 13*f* in FIG. 9, when voltages are applied to the respective electrodes while regarding the electrodes 13*c* and 13*f* as selected electrodes and electrodes other than these as nonselected electrodes, ink can be injected by any of the voltage applying methods described in Embodiments 1 through 6.

When injecting ink, although the ink face is swollen toward the opposed electrode, on this occasion if positions of the selected electrodes simultaneously injecting ink are excessively near to each other, the ink liquid faces swollen at the respective selected positions influence each other, so that ink is not injected stably.

Therefore, in order to simultaneously inject ink from a plurality of portions, positions of the plurality of selected electrodes must be at least every other positions in respect of the width of electrode and the pitch according to this embodiment. For example, although ink can be simultaneously injected at two locations of the electrodes 13*b* and 13*d*, ink cannot be simultaneously injected by the electrodes 13*b* and 13*c*. When it is intended to inject ink at two mutually adjacent locations like the electrodes 13*b* and 13*c*, it is necessary to provide a difference in timing such that ink is injected from the position of the electrode 13*c* after it has been injected from the position of the electrode 13*b*.

In the above, although the description has been given of the embodiment in which ink is simultaneously injected from two locations of selected positions, ink can be injected from more than two locations of a plurality of selected electrode positions so far as the positions satisfy the above-described restriction on the selected electrodes.

Further, according to this embodiment, although ink cannot be injected at two mutually adjacent locations of the selected electrode positions, it is understood that this condition is changed if the width of electrode and the pitch are changed.

Effect of the Invention

As has been explained above, the invention has an effect that in an electrostatic acceleration type ink jet recording system, even when distances among electrodes of a plurality of record electrodes installed at vicinities of an opening portion are sufficiently small and influence among the plurality of record electrodes is significant, ink can be injected stably from a desired position for injecting ink, the resolution of dots printed on a record medium such as record paper or the like can be improved and print output having a high picture quality can be obtained.

Further, there is achieved an effect that when a dispersing type ink is used, by changing polarities or the like of voltages applied to a plurality of record electrodes and the opposed electrode, the density of ink injected to the record paper is made variable, the expression of an intermediary tone is made possible and Print output having a high picture quality can be obtained.

What is claimed is:

1. An ink recording head comprising: means defining an opening portion; a liquid chamber for containing ink and communicating with the opening portion; a plurality of record electrodes arranged proximate the opening portion; an opposed electrode arranged opposite to and spaced apart from the opening portion at a predetermined interval; and voltage application means for applying voltages to the plurality of record electrodes and the opposed electrode by setting a potential difference between a selected one of the record electrodes and the opposed electrode smaller than a potential difference between a nonselected one of the record electrodes and the opposed electrode so that an electrostatic force is exerted to the ink to thereby inject the ink from the opening portion at a position of the selected record electrode.

2. An ink recording head according to claim 1; wherein the plurality of record electrodes are arranged at predetermined intervals; and wherein the voltage application means includes means for applying a voltage to the opposed electrode having a polarity different from a polarity of the voltage applied to the nonselected record electrode so that the electrostatic force is exerted to the ink to thereby inject the ink from the opening portion at the position of the selected record electrode.

3. An ink recording head according to claim 2; wherein the voltage applied to either or both of the selected record electrode and the nonselected record electrode comprises a pulse voltage.

4. An ink recording head according to claim 2; wherein the voltage applied to the opposed electrode comprises a pulse voltage.

5. An ink recording head according to claim 2; wherein the injected ink comprises a dissolving-type ink comprised of a colorant dissolved in a solvent and having a conductivity in the range of $1.0\times10^{-6}$ through $1.0\times10^{-10}$ (1/Ω/cm).

6. An ink recording head according to claim 2; wherein the injected ink comprises a dispersing-type ink comprised of a colorant dispersed in a dispersion medium and having a conductivity of a dispersing agent in the range of $1.0\times10^{-6}$ through $1.0\times10^{-10}$ (1/Ω/cm).

7. An ink recording head according to claim 6; further comprising means for changing a density of the injected ink by reversing a polarity of the voltage applied to the selected record electrode and a polarity of the voltage applied to the opposed electrode, or by reversing a polarity of the nonselected record electrode and the polarity of the voltage applied to the opposed electrode.

8. An ink recording head according to claim 1; wherein the plurality of record electrodes are arranged at predetermined intervals; and wherein the voltage application means includes means for applying a voltage to the opposed electrode having a polarity the same as a polarity of the voltage applied to the selected record electrode so that the electrostatic force is exerted to the ink to thereby inject the ink from the opening portion at a position of the selected record electrode.

9. An ink recording head according to claim 8; wherein the voltage applied to the opposed electrode comprises a pulse voltage.

10. An ink recording head according to claim 8; wherein the injected ink comprises a dissolving-type ink comprised of a colorant dissolved in a solvent and having a conductivity in the range of $1.0\times10^{-6}$ through $1.0\times10^{-10}$ (1/Ω/cm).

11. An ink recording head according to claim 8; wherein the injected ink comprises a dispersing-type ink comprised of a colorant dispersed in a dispersion medium and having a conductivity of a dispersing agent in the range of $1.0\times10^{-6}$ through $1.0\times10^{-10}$ (1/Ω/cm).

12. An ink recording head according to claim 11; further comprising means for changing a density of the injected ink by reversing a polarity of the voltage applied to the selected record electrode and a polarity of the voltage applied to the opposed electrode, or by reversing a polarity of the nonselected record electrode and the polarity of the voltage applied to the opposed electrode.

13. An ink recording head according to claim 8; wherein the voltage applied to either or both of the selected record electrode and the nonselected record electrode comprises a pulse voltage.

14. An ink recording head according to claim 13; wherein the voltage applied to the opposed electrode comprises a pulse voltage.

15. An ink recording head according to claim 14, wherein the injected ink comprises a dissolving-type ink comprised of a colorant dissolved in a solvent and having a conductivity in the range of $1.0\times10^{-6}$ through $1.0\times10^{-10}$ (1/Ω/cm).

16. An ink recording head according to claim 14; wherein the injected ink comprises a dispersing-type ink comprised of a colorant dispersed in a dispersion medium and having a conductivity of a dispersing agent in the range of $1.0\times10^{-6}$ through $1.0\times10^{-10}$ (1/Ω/cm).

17. An ink recording head according to claim 16; further comprising means for changing a density of the injected ink by reversing a polarity of the voltage applied to the selected record electrode and a polarity of the voltage applied to the opposed electrode, or by reversing a polarity of the nonselected record electrode and the polarity of the voltage applied to the opposed electrode.

18. An ink recording head according to claim 13; wherein the injected ink comprises a dissolving-type ink comprised of a colorant dissolved in a solvent and having a conductivity in the range of $1.0\times10^{-6}$ through $1.0\times10^{-10}$ (1/Ω/cm).

19. An ink recording head according to claim 13; wherein the injected ink comprises a dispersing-type ink comprised of a colorant dispersed in a dispersion medium and having a conductivity of a dispersing agent in the range of $1.0\times10^{-6}$ through $1.0\times10^{-10}$ (1/Ω/cm).

20. An ink recording head according to claim 19; further comprising means for changing a density of the injected ink by reversing a polarity of the voltage applied to the selected record electrode and a polarity of the voltage applied to the opposed electrode, or by reversing a polarity of the nonselected record electrode and the polarity of the voltage applied to the opposed electrode.

21. An ink recording head according to claim 1; wherein the voltage applied to either or both of the selected record electrode and the nonselected record electrode comprises a pulse voltage.

22. An ink recording head according to claim 1; wherein the voltage applied to the opposed electrode comprises a pulse voltage.

23. An ink recording head according to claim 1; wherein the injected ink comprises a dissolving-type ink comprised of a colorant dissolved in a solvent and having a conductivity in the range of $1.0\times10^{-6}$ through $1.0\times10^{-10}$ (1/Ω/cm).

24. An ink recording head according to claim 1; wherein the injected ink comprises a dispersing-type ink comprised of a colorant dispersed in a dispersion medium and having a conductivity of a dispersing agent in the range of $1.0\times10^{-6}$ through $1.0\times10^{-10}$ (1/Ω/cm).

25. An ink recording head according to claim 24; further comprising means for changing a density of the injected ink by reversing a polarity of the voltage applied to the selected record electrode and a polarity of the voltage applied to the opposed electrode, or by reversing a polarity of the nonselected record electrode and the polarity of the voltage applied to the opposed electrode.

26. An ink recording head according to claim 1; wherein the voltage application means includes means for applying voltages to the plurality of record electrodes and the opposed electrode by setting a potential difference between a selected one of the record electrodes and the opposed electrode to a value smaller than a preselected threshold voltage value and by setting a potential difference between a nonselected one of the record electrodes and the opposed electrode to a value greater than the preselected threshold voltage value.

27. A method for injecting ink, comprising the steps of: providing an ink recording head having an opening portion, a liquid chamber containing ink and communicating with the opening portion, a plurality of record electrodes arranged proximate the opening portion, and an opposed electrode arranged opposite to and spaced-apart from the opening portion at a predetermined interval; and applying voltages to the plurality of record electrodes and the opposed electrode by setting a potential difference between a selected one of the record electrodes and the opposed electrode smaller than a potential difference between a nonselected one of the record electrodes and the opposed electrode so that an electrostatic force is exerted to the ink to thereby inject the ink from the opening portion at a position of the selected record electrode.

28. A method according to claim 27; wherein the providing step comprises providing the plurality of record electrodes arranged at predetermined intervals; and wherein the applying step comprises applying a voltage to the opposed electrode having a polarity different from a polarity of the voltage applied to the nonselected record electrode so that the electrostatic force is exerted to the ink to thereby inject the ink from the opening portion at the position of the selected record electrode.

29. A method according to claim 27; wherein the providing step comprises providing plurality of record electrodes arranged at predetermined intervals; and wherein the applying step comprises applying a voltage to the opposed electrode having a polarity the same as a polarity of the voltage applied to the selected record electrode so that the electrostatic force is exerted to the ink to thereby inject the ink from the opening portion at a position of the selected record electrode.

30. A method according to claim 29; wherein the applying step comprises applying a pulse voltage to either or both of the selected record electrode and the nonselected record electrode.

31. A method according to claim 30; wherein the applying step comprises applying a pulse voltage to the opposed electrode.

32. A method according to claim 31; wherein the providing step comprises providing a liquid chamber containing a dissolving-type ink comprised of a colorant dissolved in a solvent and having a conductivity in the range of $1.0\times10^{-6}$ through $1.0\times10^{-10}$ (1/Ω/cm).

33. A method according to claim 31; wherein the providing step comprises providing a liquid chamber containing a dispersing-type ink comprised of a colorant dispersed in a dispersion medium and having a conductivity of a dispersing agent in the range of $1.0\times10^{-6}$ through $1.0\times10^{-10}$ (1/Ω/cm).

34. A method according to claim 33; wherein the applying step comprises changing a density of the injected ink by reversing a polarity of the voltage applied to the selected record electrode and a polarity of the voltage applied to the opposed electrode, or by reversing a polarity of the nonselected record electrode and the polarity of the voltage applied to the opposed electrode.

35. A method according to claim 27; wherein the applying step comprises applying voltages to the plurality of record electrodes and the opposed electrode by setting a potential difference between a selected one of the record electrodes and the opposed electrode to a value smaller than a preselected threshold voltage value and by setting a potential difference between a nonselected one of the record electrodes and the opposed electrode to a value greater than the preselected threshold voltage value.

36. An ink recording head comprising: a housing having an ink chamber for containing ink and an opening portion in communication with the ink chamber; a plurality of record electrodes disposed in the housing; an opposed electrode arranged opposite to and spaced apart from the opening portion of the housing; and voltage application means for applying voltages to the plurality of record electrodes and the opposed electrode by setting a potential difference between a selected one of the record electrodes and the opposed electrode to a value smaller than a preselected threshold voltage value and by setting a potential difference between a nonselected one of the record electrodes and the opposed electrode to a value greater than the preselected threshold voltage value so that an electrostatic force is exerted to the ink to thereby inject the ink from the opening portion of the housing at a position of the selected record electrode.

37. An ink recording head according to claim 36; wherein the housing comprises an upper plate, a lower plate, and a plurality of spacers disposed between the upper and lower plates to define the opening portion of the housing; and wherein the record electrodes are connected to the lower plate of the housing.

38. An ink recording head according to claim 36; wherein the ink recording head does not have a gate electrode disposed between the opening portion of the housing and the opposed electrode.

* * * * *